US006660108B2

(12) United States Patent
Doko et al.

(10) Patent No.: US 6,660,108 B2
(45) Date of Patent: Dec. 9, 2003

(54) METHOD FOR MANUFACTURING A FIN MATERIAL FOR BRAZING

(75) Inventors: Takeyoshi Doko, Tokyo (JP); Akira Kawahara, Tokyo (JP)

(73) Assignee: The Furukawa Electric Co., Ltd., Tokyo (JP)

( * ) Notice: Subject to any disclaimer, the term of this patent is extended or adjusted under 35 U.S.C. 154(b) by 65 days.

(21) Appl. No.: 09/815,383

(22) Filed: Mar. 22, 2001

(65) Prior Publication Data

US 2002/0004977 A1 Jan. 17, 2002

(30) Foreign Application Priority Data

Mar. 23, 2000 (JP) ..... 2000-082979

(51) Int. Cl.[7] ..... C22F 1/04
(52) U.S. Cl. ..... 148/551; 148/552; 148/696
(58) Field of Search ..... 148/551, 552, 148/696

(56) References Cited

U.S. PATENT DOCUMENTS 5,380,379 A * 1/1995 Maiwald et al. ..... 148/697
5,489,347 A * 2/1996 Himuro et al. ..... 148/437
6,165,291 A * 12/2000 Jin et al. ..... 148/551

FOREIGN PATENT DOCUMENTS

EP 0637481 A1 1/1994
JP 07-216485 8/1995
JP 08-104934 4/1996
JP 09-157807 6/1997
JP 11-131166 5/1999

OTHER PUBLICATIONS

European Search Report dated Aug. 6, 2001 from Application EP 01 30 2609.

* cited by examiner

*Primary Examiner*—Roy King
*Assistant Examiner*—Janelle Combs Morillo
(74) *Attorney, Agent, or Firm*—Knobbe Martens Olson & Bear LLP

(57) ABSTRACT

A method of producing an aluminum alloy fin material for brazing, which comprises:

casting an aluminum alloy by continuous cast-rolling, wherein the alloy comprises above 0.1 wt % to 3 wt % of Ni, above 1.5 wt % to 2.2 wt % of Fe, and 1.2 wt % or less of Si, and at least one of Zn, In, and Sn in given amounts, the balance being unavoidable impurities and aluminum, and cold-rolling in which annealing at 250 to 500° C. is conducted plural times midway in the cold-rolling, thereby producing the fin material of a given thickness;

wherein a cast coil with a given thickness is produced by continuous cast-rolling, and wherein the second last annealing is carried out with a given thickness, and wherein the final annealing is carried out under heating conditions that do not allow complete recrystallization.

9 Claims, 1 Drawing Sheet

METHOD FOR MANUFACTURING A FIN MATERIAL FOR BRAZING

FIELD OF THE INVENTION

The present invention relates to a method for manufacturing an Al—Ni—Fe-series alloy fin material for brazing that has excellent corrosion resistance, mechanical strength, and thermal conductivity. More particularly, the present invention relates to a method for continuously manufacturing an Al—Ni—Fe-series alloy rolling coil for fin material, capable of manufacturing fin material having reduced thickness with excellent productivity while improving the characteristics thereof.

BACKGROUND OF THE INVENTION

Many automotive heat exchangers are made from Al and Al alloys and fabricated by brazing. In general, for brazing, Al—Si-series brazing material is used, and consequently, brazing is carried out at a high temperature of around 600° C. Heat exchangers, like radiators, etc., have thin-wall fins (2) machined in a corrugated form among a plurality of flat tubes (1) integrally built as shown in FIG. 1. Both ends of the relevant flat tube (1) are allowed to be open to the space formed by a header (3) and a tank (4), respectively. High-temperature refrigerant is fed to the space on the tank (4) side, through the inside of the flat tube (1), from the space on the other tank side. The refrigerant brought to low temperatures by exchanging heat at the tube (1) and the fin (2) sections, is circulated again.

In recent years, heat exchangers have achieved light weight and small size, and consequently, the heat efficiency of the heat exchanger must be improved, and improvement of heat conductivity of the material is desired. In particular, improving the heat conductivity of the fin material has been investigated, and an alloy fin material whose alloy composition is brought close to that of pure aluminum has been proposed as heat-conducting fins. However, when the wall thickness of the fin is reduced, the fin may collapse at the time of assembling the heat exchanger, or it may be destroyed during use as a heat exchanger, if the mechanical strength of fin is not sufficient. Pure aluminum-series alloy fins have a defect of lacking mechanical strength, and to increase mechanical strength, adding alloying elements, such as Mn, etc., is effective, but in the process for manufacturing heat exchangers, there is a brazing process in which the fins are heated to nearly 600° C., causing a problem in that elements added to alloys to improve mechanical strength become solid-soluble again during heating for brazing, and they may block improvement of the heat conductivity.

As fin materials that solve these problems, alloys with Ni and Co added to Al—Si—Fe alloys are proposed, which exhibit characteristics of excellent mechanical strength and heat conductivity (JA-A-7-216485 ("JP-A" means unexamined published Japanese patent application), JP-A-8-104934, etc.).

However, these fin materials need a special fabrication process, as shown in JP-A-9-157807, to secure melting resistance during brazing. In particular, of these fin materials, when they contain more than 1.5% of Fe (% means wt %; the same applies hereinafter), the final cold-rolling ratio must be reduced in order to prevent melting at the time of brazing. This corresponds to Sample No. 7 of the examples of JP-A-9-157087, in which a cold-rolling ratio as low as 9.8% is proposed. That is, carrying out the pass at a low rolling ratio in the industrial rolling of thin-wall aluminum alloy materials, results in difficulty achieving sheet flatness during rolling, causing a problem of being industrially difficult to roll, and a low final cold-rolling ratio causes a problem of difficulty forming corrugates themselves, because mechanical strength difference is too small from the O-material condition.

Furthermore, in aluminum alloys with Fe exceeding 1.5% added together with Ni, an Al—Fe—Ni-series intermetallic compound is generated, and these are factors of improving mechanical strength and heat conductivity, but they also cause a problem of lowering the corrosion resistance of the fin material itself. The fin material protects the tube, as a sacrificial corrosion-preventive material, but if the amount of corrosion of the fin material itself is excessively great, the fin is consumed by corrosion in the early stages and is unable to prevent tubes from corrosion over a long time.

In addition, using coils fabricated by casting these alloys by the continuous casting rolling method to manufacture, fin materials has been attempted, but it causes a problem of broken coils midway during cold-rolling it up to the fin materials. Coil breakage during rolling at high speed not only causes a failure to obtain products but also sets fire to oil of the cold-rolling machine, which is dangerous.

SUMMARY OF THE INVENTION

The present invention is a method of producing an aluminum alloy fin material for brazing, which comprises:

casting an aluminum alloy by continuous cast-rolling, wherein the aluminum alloy comprises more than 0.1 wt % but 3 wt % or less of Ni, more than 1.5 wt % but 2.2 wt % or less of Fe, and 1.2 wt % or less of Si, and at least one selected from the group consisting of 4 wt % or less of Zn, 0.3 wt % or less of In, and 0.3 wt % or less of Sn, and further comprises, if necessary, at least one selected from the group consisting of 3.0 wt % or less of Co, 0.3 wt % or less of Cr, 0.3 wt % or less of Zr, 0.3 wt % or less of Ti, 1 wt % or less of Cu, 0.3 wt % or less of Mn, and 1 wt % or less of Mg, the balance being unavoidable impurities and aluminum, and cold-rolling in which annealing at 250 to 500° C. is conducted two times or more midway in the cold-rolling process, thereby producing the aluminum alloy fin material of a thickness of 0.10 mm or less;

wherein a cast coil with a thickness of 2.5 mm or more but 9 mm or less is produced by the continuous cast-rolling, and wherein the second last annealing during the cold-rolling step is carried out with a thickness of 0.4 mm or more but 2 mm or less for the cold-rolled aluminum alloy, and wherein the final annealing is carried out under heating conditions that do not allow complete recrystallization.

Other and further, features, and advantages of the invention will appear more fully from the following description, take in connection with the accompanying drawings.

DETAILED DESCRIPTION OF THE INVENTION

Figure 1:
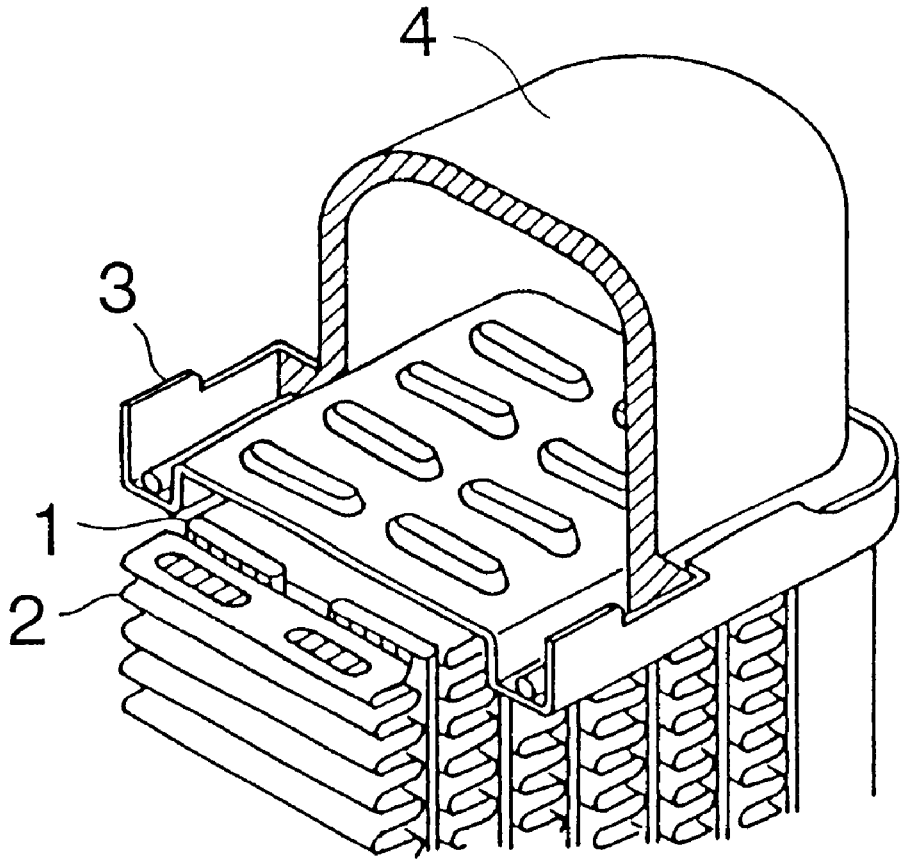
FIG. 1 is a schematic view showing a radiator.

That is, the present invention provides the following means:

(1) A method of producing an aluminum alloy fin material for brazing, which comprises:

casting an aluminum alloy by continuous cast-rolling, wherein the aluminum alloy comprises more than 0.1 wt % but 3 wt % or less of Ni, more than 1.5 wt % but 2.2 wt % or less of Fe, and 1.2 wt % or less of Si, and at least one selected from the group consisting of 4 wt % or less of Zn, 0.3 wt % or less of In, and 0.3 wt % or less of Sn, and further comprises, if necessary, at least one selected from the group consisting of 3.0 wt % or less of Co, 0.3 wt % or less of Cr, 0.3 wt % or less of Zr, 0.3 wt % or less of Ti, 1 wt % or less of Cu, 0.3 wt % or less of Mn, and 1 wt % or less of Mg, the balance being unavoidable impurities and aluminum, and cold-rolling in which annealing at 250 to 500° C. is conducted two times or more midway in the cold-rolling process, thereby producing the aluminum alloy fin material of a thickness of 0.10 mm or less;

wherein a cast coil with a thickness of 2.5 mm or more but 9 mm or less is produced by the continuous cast-rolling, and wherein the second last annealing during the cold-rolling step is carried out with a thickness of 0.4 mm or more but 2 mm or less for the cold-rolled aluminum alloy, and wherein the final annealing is carried out under heating conditions that do not allow complete recrystallization.

(2) The method according to the above (1), wherein an aluminum alloy contains 0.9 to 2.0 wt % of Ni.

(3) The method according to the above (1), wherein an aluminum alloy contains more than 1.5 wt % but 2.0 wt % or less of Fe.

(4) The method according to the above (1), wherein an aluminum alloy contains 0.3 to 1.0 wt % of Zn.

(5) The method according to the above (1), wherein an aluminum alloy contains 0.3 to 2.0 wt % of Co.

(6) The method according to the above (1), wherein an aluminum alloy contains 0.05 to 0.3 wt % of Cu.

(7) The method according to the above (1), wherein the second from the last annealing is carried out for the cold-rolled aluminum alloy sheet of 0.6 to 1.2 mm thickness, during the cold-rolling process.

(8) The method according to the above (1), wherein the final annealing temperature is in the range of 350 to 460° C.

(9) The method according to the above (1), wherein the final annealing is carried out during the cold-rolling process before achieving final 10% or more of cold-rolling ratio.

The component elements of the alloy used for the manufacturing method of the present invention are described in below.

In the present invention, more than 0.1 wt % but 3 wt % or less of Ni, and more than 1.5 wt % but 2.2 wt % or less of Fe are contained to solve the problems that related to fin material mechanical strength and thermal conductivity after brazing, by addition Fe and Ni. In particular, the reason the alloys are limited to those that have more than 1.5 wt % of Fe, is as follows: if it is 1.5 wt % or less, the alloy can be manufactured by the conventional manufacturing method, and thus it is unnecessary to take the trouble to carry out this process. In addition, the reason the alloys are limited to those that contain not greater than 2.2 wt % of Fe, is as follows: if it exceeds the upper limit, it is unable to improve the corrosion resistance of the fin material, even if the method according to the present invention is used. The lower limit of Ni was determined by the amount that has an effect to improve mechanical strength and electric conductivity by coexistence with Fe. The upper limit of Ni is decided because, as with Fe, if it exceeds the range of the present invention, the corrosion resistance of the fin material cannot be improved even if the method according to the present invention is used.

The amounts of Ni and Fe added are determined by the foregoing, but in order to secure high mechanical strength, 0.6 wt % or more of Ni is recommended, and in particularly, 0.9 wt % or more is recommended. In addition, for the stability of continuous casting, discussed later, 2 wt % or less of Ni is recommended. Furthermore, in order to increase the stability of continuous casting and further improve the corrosion resistance of thin-walled fin materials, 2.0 wt % or less of Fe is particularly recommended.

In addition to the above Ni and Fe, the alloy contains at least one of components selected from 4 wt % or less of Zn, 0.3 wt % or less of In, and 0.3 wt % or less of Sn. Components other than these are not compulsory but may be contained within the range that would not damage the objects of the invention. For such optional components, one or two or more of 3.0 wt % or less of Co, 0.3 wt % or less of Cr, 0.3 wt % or less of Zr, 0.3 wt % or less of Ti, 1 wt % or less of Cu, 0.3 wt % or less of Mn, or 1 wt % or less of Mg, and unavoidable impurities, may be contained. These elements indicate important functions from the viewpoint of characteristics when the alloy is used for fin material. The function and the reasons for limitation will be described for each element, as follows.

Si improves mechanical strength when added. In addition to increasing the mechanical strength by solid-solution hardening of Si itself, when Si coexists particularly with Fe, Ni, and Co, Si serves to promote precipitation of Fe, Ni, and Co. In the fin material according to the present invention, it is essential to prevent the coarsening of Al—Fe-series intermetallic compounds. Since a large amount of intermetallic compounds precipitate when Si is added, the size of individual intermetallic compounds becomes smaller than that when Si is not added. This precipitation-promoting function is not insufficient when the Si content is 0.03 wt % or less, and fins will melt at the time of heating for brazing if it exceeds 1.2 wt %. Consequently, when Si is added, it is desirable to add it in such a manner that the content becomes more than 0.03 wt % but 1.2 wt % or less, but the above-mentioned precipitation-promoting function enhances when the Si content is 0.3 wt % or more. When the Si content is excessively increased, solid-solute Si lowers the thermal conductivity of the fin, and 0.8 wt % or less is desirable.

Co functions in a manner similar to Ni. Consequently, when Co is added, the added amount is held to between more than 0.1 wt % but 3.0 wt % or less, but it exhibits excellent characteristics particularly in the range from 0.3 wt % to 2 wt %. However, as compared to Ni, Co has slightly lower thermal conductivity and provides weaker effects to divide the Al—Fe-series compounds. In addition, Co is more expensive than Ni. In the present invention, it is possible to use Co in place of Ni, or to simultaneously add Ni and Co, but since adding Ni alone provides greater effects from the viewpoints of characteristics and cost, it is recommended to add Ni. The lower limit of Co addition is preferably 0.1 wt %, but this is applied when Co is added independently, and when Co is added together with Ni, it may be added at a smaller ratio.

The addition of Zr and Cr at 0.3 wt % or less improves mechanical strength, and Zr is added to coarsen the recrystallized particles of fin material generated at the time of brazing, and to prevent drooping of the fin and diffusion of the brazing filler into the fin. However, alloys with Zr and Cr added tend to cause clogging of the nozzle when continuous casting is carried out, and they may prevent casting from taking place. Consequently, it is desirable not to add Zr and Cr, and if they are added, it is particularly recommended to add them at 0.08 wt % or less.

0.3% or less of Ti is added, primarily to improve mechanical strength. However, alloys with Ti added tend to cause clogging of the nozzle when continuous casting is carried out, and they may prevent casting from taking place. Consequently, it is desirable not to add Ti, and if it is added, it is particularly recommended to add it at 0.08 wt % or less. Ti may be added for the purpose of refining the cast microstructure, but even in such an event, 0.02 wt % or less of Ti can successfully achieve the purpose.

4 wt % or less of Zn, 0.3 wt % or less of In, and 0.3 wt % or less of Sn are added, to give sacrificial corrosion-preventing effects to the fin material. The amount added and the elements added should be decided according to the corrosion-prevention characteristics and thermal conductivity required for the fin material. In and Sn can exhibit sufficient sacrificial corrosion-preventing effects when added in small quantity, but they have problems in that they are expensive and their alloy scrap cannot be recycled for other alloying materials. Consequently, in the present invention, the addition of Zn is particularly recommended. Since Zn lowers the corrosiveness of the fin material itself when added in a larger quantity, it is preferably added at 2 wt % or less, and more suitably at 1 wt % or less. The lower limit of each element may be decided according to the material for which the corrosion prevention is provided, but 0.3 wt % or more is generally desirably added.

In the present invention, there is a case to further add Cu. Cu is added primarily to improve mechanical strength. When Cu is added, no effect of improving mechanical strength is achieved if it is 0.05 wt % or less. Because when the addition amount is increased, the function to reduce the sacrificial anode effects increases, 1 wt % or less of Cu is added, but 0.3 wt % or less of Cu is particularly recommended. Since Cu makes the potential of the fin material noble and works to reduce the sacrificial anode effects, Cu must be added together with any of the elements Zn, In, and Sn, when Cu is added.

Mn may be added to improve mechanical strength, but only a slight amount of addition would greatly lower the thermal conductivity. Consequently, 0.3 wt % or less of Mn should be added, but it is preferable not to add Mn from the viewpoint of thermal conductivity.

Mg also may be added to improve mechanical strength, but since it reacts with the flux in the case of NB brazing and degrades brazability, Mg must not be added when fin material for NB brazing is produced. In the case of fin materials for vacuum brazing, 1 wt % or less of Mg should be added, but since Mg evaporates during brazing and the effect is small, it is recommended not to add Mg.

Now, with respect to unavoidable impurities and the elements added for reasons other than those mentioned above, there are B, etc., added together with Ti, in order to refine the ingot microstructure, and these elements may be contained if the content is 0.03% or less, respectively.

The manufacturing method according to the present invention will be described hereinafter.

First, in the present invention, continuous casted and rolled coil is fabricated in thickness from 2.5 mm or more and 9 mm or less, by the continuous cast-rolling method. The continuous cast-rolling method is a process for continuously casting strips several mm of thickness from molten aluminum alloy, to directly fabricate the coil, and the Hunter method, the 3C method, etc., are known as typical methods. Compared to the case in which ingots are fabricated by the DC casting method, and coils several mm of thickness are fabricated by hot rolling, in the continuous cast-rolling method, the cooling rate at the time of casting is great, and it is possible to subtly crystallize intermetallic compounds at the time of casting, and in the case of alloys as used for the present invention, which contain a large volume of Fe, the continuous cast-rolling method provides effects of improving mechanical strength. In addition, the results of investigation by the inventors indicate that, because in the continuous cast-rolling method, Fe and Ni are in a supersaturated, solid-solute state, as compared with the DC casting method, the corrosion resistance of the fin material itself can be improved by optimizing the subsequent process.

The reason that the coil cast thickness is controlled to 2.5 mm or more, and 9 mm or less, for the continuous cast-rolling method in the present invention, is as follows: when the thickness is below 2.5 mm, waviness is generated in the sheet at the time of continuous casting, and the sheet cannot be rolled in the subsequent cold-rolling process, and when the thickness exceeds 9 mm, no sufficient rapid-cooling effects are achieved, and the amount of elements in a supersaturated, solid-solute state is reduced, resulting in no enhancement of the corrosion resistance of the fin material itself.

The coil obtained by continuous cast-rolling is rolled to 0.10 mm or less in the cold-rolling process, to produce the fin material, and on its way, annealing is carried out twice or more times, at temperatures in the range from 250° C. to 500° C. In such an event, the second last annealing is performed at a sheet thickness from 0.4 mm to 2 mm, and the final annealing is carried out under heating conditions at which recrystallization does not complete.

The combination of these conditions has made it possible to improve the corrosion resistance of the fin material itself, improve the productivity of the fin material (prevent breakage during cold-rolling), and improve the final cold-rolling ratio of the fin material.

First, discussion will focus on the number of annealings. Because with one annealing, supersaturated solid-soluble Fe and Ni do not sufficiently precipitate, Fe and Ni precipitate at the recrystallization boundary when the fin material is heated for brazing. As the precipitate increases along recrystallization boundaries after brazing, corrosion increases along crystal boundaries when corrosion occurs. Because in the fin material of this alloy series, it tends to have one crystal particles in the thickness direction, as corrosion develops along particle boundaries, the fin breaks into pieces, and the anticorrosion life of the fin material itself lowers, even if the whole fin is not corroded.

There is a temperature condition at which a sufficient precipitate amount can be secured in one annealing, but annealing under such a condition would allow the precipitate to grow and to coarsen, and it would lower mechanical strength of the fin material itself, and in addition it would cause corrosion to easily take place around the precipitates, and the corrosion resistance of the fin material itself lowers.

In addition to the foregoing, for the purpose of preventing breakage at the time of cold-rolling, discussed when the reasons for limiting the sheet thickness at the second from the last annealing (the first annealing when annealing is carried out twice) are later discussed, annealing during cold-rolling is carried out twice or more. By the way, carrying out annealing three times or more will not result in any problems from the viewpoint of characteristics. However, as the process is increased, the manufacturing cost increases, so that annealing three times or less is preferably recommended, and more suitably twice is recommended.

The reasons that the sheet thickness at the second from the last annealing (the first annealing when annealing is carried out twice) is limited to 0.4 mm or more and 2 mm or less, are based on the results of investigations made by the inventors on the breakage generated when cold-rolling continuously casted and rolled coil, in which the inventors located the following causes and completed the present invention as measures against the breakage. They are discussed as follows in detail.

In the present invention, the coil used in continuous cast-rolling is used, but since continuous cast-rolling is a method for continuously carrying out casting from several hours to scores of hours, it has been found that intermetallic compounds scores of $\mu$m or larger exist sometimes in more than on place, when the alloy used for the present invention is cast. This existence of the intermetallic compounds is assumed that the intermetallic compound collecting inside the nozzle tip, etc., flows out together with the molten aluminum when it exceeds a specified amount and exists in the cast coil. This kind of intermetallic compound serves as an initiation point of breakage when the material is rolled to a thin sheet thickness, but it is difficult to prevent the generation during casting.

The inventors studied how to prevent the generation of localized cracks in the vicinity of intermetallic compounds as much as possible, and how to prevent breakage in the whole width direction even if any crack is generated, on the condition that this kind of intermetallic compound exists in continuously casted coil at a specified probability. And, they have found that it is effective to soften the portion of the aluminum alloy in the vicinity of intermetallic compound, by carrying out annealing, and in particular, it is most effective to carry out annealing with a sheet thickness in the range of 0.4 mm or more, and 2 mm or less.

Because annealing at a sheet thickness exceeding 2 mm hardens the aluminum alloy section of the matrix by the subsequent cold-rolling, breakage occurs when the sheet thickness reaches about 0.1 mm, unless annealing is carried out again in the range of the above sheet thickness. That is, even if annealing is not carried out in the above-mentioned range or annealing is carried out at the sheet thickness less than 0.4 mm, microscopic cracks occur around the intermetallic compound by cold-rolling a sheet thickness from 2 mm to 0.4 mm, and when the sheet thickness becomes about 0.1 mm, breakage occurs, with these cracks as the initiation points, during cold-rolling.

The reason that annealing at a sheet thickness from 0.4 mm or more to 2 mm or less is carried out at the second from the last, is as follows: if it is carried out as the last annealing, the final cold-rolling ratio thereafter becomes excessively large, and breakage is easily to occur in the vicinity of the final cold-rolling pass. In addition, if annealing is carried out in this sheet thickness range, only one additional annealing is enough thereafter, and it is wasteful from the viewpoint of energy that the annealing is carried out as third or more from the last.

Based on the foregoing, the sheet thickness when the second from the last annealing (the first annealing when annealing is carried out twice) is carried out, is set to 0.4 mm or more, and 2 mm or less, but carrying out annealing at 0.6 mm or more, and 1.2 mm or less, is particularly effective for preventing breakage in the cold-rolling process.

The final annealing is carried out at a temperature that does not complete recrystallization of the fin material. Carrying out annealing at a temperature that does not complete recrystallization, means to preferably carry out annealing under the condition in which particles recrystallized with a size of 20 $\mu$m or more at the sheet surface position account for 30% or less. When the ratio of 20 $\mu$m or more recrystallized particles exceeds 30%, recrystallization rapidly takes place and may be completed. One reason for this, is that supersaturated solid-soluble Fe and Ni is precipitated when the sheet is heated for annealing, but if these elements do not complete recrystallization and dislocation remains, they diffuse along the dislocation and increase the precipitated amount. In addition, because the precipitation after the completion of recrystallization, progresses in such a manner as to coarsen the precipitated particles generated before the completion of recrystallization, it provides little effects to improve mechanical strength of fin material, and it serves as a factor to lower the corrosion resistance of the fin material itself. Furthermore, for the third reason, when annealing is carried out under conditions to complete recrystallization, the number of precipitates existing at the recrystal boundary increases at the time of heating for brazing, after the sheet becomes the fin material through the subsequent cold-rolling, and the corrosion resistance of the fin material itself decreases. This is because when recrystallization occurs at the time of annealing, the dislocation introduced at the subsequent cold-rolling tends to move during heating for brazing, and forms recrystal grains, and in such an event, a large number of precipitates exist at the boundary, so that the precipitated particles prevent the boundary from moving.

Consequently, the final annealing should be carried out at a temperature range from 250° C. or higher, and 500° C. or lower, in which recrystallization does not complete. At temperatures lower than 250° C., precipitation does not take place satisfactorily, and due to the reasons mentioned above, the corrosion resistance of the fin material itself lowers. When the temperature exceeds 500° C., the precipitated particles are coarsened and the mechanical strength lowers, and furthermore, the corrosion resistance of the fin material itself lowers. Based on the foregoing, the final annealing temperature range should be 250° C. or higher, and 500° C. or lower, and more preferably 350° C. or higher, and 460° C. or lower, from the viewpoint of depositing a sufficient amount of fine precipitates Since the specific recrystallization temperature varies according to the alloying composition and heat history before the final annealing, recrystallization may have been completed even in the above-mentioned temperature range, and therefore, in actuality, the final annealing conditions should be decided after confirming in advance the temperature at which recrystallization dose not complete.

The final annealing time is preferably between 30 minutes and 4 hours, but it is not limited to this. With annealing below 30 minutes, it is difficult to stabilize the temperature of the whole coil, and annealing exceeding 4 hours results in wasted energy.

The final annealing is carried out at a sheet thickness at which a 10% or more, subsequent cold-rolling ratio is achieved. Annealing below 10% results in unstable corrugate formability. The upper limit is not particularly defined, but in general, cold-rolling is preferably carried out at a 60% or less rolling ratio, and more suitably at 30% or less.

The foregoing are the final annealing conditions, but it is recommended to carry out annealing before the final annealing at a temperature lower than that at the final annealing. Carrying out annealing at a temperature higher than that at the final annealing, makes it difficult to cause precipitation at the final annealing, and results in lowering the corrosion resistance of the fin material itself. Because precipitation is intended to take place at the final annealing, in annealing before the final annealing, fine precipitates that serve as their nuclei should be deposited in large quantity, and the temperature is therefore recommended to be, particularly, 400° C. or lower. From the viewpoint of thoroughly carrying out softening to prevent breakage during cold-rolling, 270° C. or higher is recommended.

The time for annealing is preferably between 30 minutes and 4 hours, but it should not be limited to this. With annealing below 30 minutes, it is difficult to stabilize the temperature of the whole coil, and annealing exceeding 4 hours results in wasted energy.

In the present invention, this annealed material is cold-rolled to form a thin-wall fin material for brazing (preferably, 0.1 mm or thinner). Because the present invention relates to a method for manufacturing brazing sheet fins with high mechanical strength and high heat conductivity, and more specifically, a method that solves problems generated when the material is formed into 0.1 mm or thinner fin material, and that improves the corrosion resistance of such a fin material itself, needless to say, the present invention may relate to a method for manufacturing fin material exceeding 0.1 mm of thickness, but there is no need to use the coil manufactured under the conditions of the present invention unless the characteristics obtained by the manufacturing conditions of the present invention are required. If the sheet is 0.1 mm or thicker, there is no need to manufacture the alloy of the chemical composition according to the present invention by the manufacturing method according to the present invention.

In the present invention, an aluminum alloy fin material for brazing is manufactured. The present invention relates to a manufacturing method intended to solve problems of alloys which are considered to have characteristics suitable for fin material for brazing.

Now, brazing referred to here may be any of the NB method, the VB method, etc., which have been popularly practiced to date, and particularly, the NB method is recommended. This is because better productivity is achieved by the NB method.

As described herein, according to the manufacturing method of the present invention, it is possible to manufacture fin material with reduced wall thickness of an Al—Ni—Fe-series alloy, which is an alloy for fin materials with high mechanical strength and high heat conductivity, by the use of continuous cast-rolling, and the fin material obtained provides excellent corrosion resistance by itself, and achieves remarkable industrial effects.

EXAMPLE

The present invention will be described further in detail based on the following examples, but the present invention is not meant to be limited by these examples.

The aluminum alloys of the chemical composition shown in Table 1 were processed by the manufacturing process shown in Table 2, and 0.06-mm-thick fin materials were fabricated. The roll diameter of the continuous casting and rolling machine used was 618 mm, and the width of the continuous casting and rolling coil manufactured was 1000 mm. Table 3 shows the cold-rolling condition. With respect to the material that broke halfway, the fin material was fabricated in the laboratory from the remainder section. The fin materials obtained were subject to the CASS test for one week, after they were heated for NB brazing at 600° C. for 3 minutes, and they were investigated for mass loss due to corrosion. Table 3 also shows the results.

TABLE 1

| Alloy No. | Ni | Fe | Si | Co | Cr | Zr | Ti | Zn | In | Sn | Cu | Mn | Mg | Al |
|---|---|---|---|---|---|---|---|---|---|---|---|---|---|---|
| A | 1.1 | 1.7 | 0.5 | — | — | — | — | 0.6 | — | — | — | — | — | balance |
| B | 1.6 | 1.8 | 0.4 | — | — | 0.04 | 0.05 | 1 | — | — | — | — | — | balance |
| C | 1.2 | 1.7 | 0.5 | 0.3 | 0.05 | — | — | 0.9 | — | 0.02 | 0.1 | 0.2 | 0.2 | balance |
| D | 1.4 | 1.8 | 0.5 | — | — | — | 0.05 | 0.5 | 0.04 | — | — | — | — | balance |
| E | 1.6 | 2.6 | 0.5 | — | — | — | — | 0.6 | — | — | — | — | — | Balance |

wt %

TABLE 2

| | No. | Alloy No. | Method for manufacturing coils before cold-rolling | Cold-rolling and annealing conditions (the underlined indicates the sheet thickness and conditions of annealing carried out the second last annealing |
|---|---|---|---|---|
| This Invention examples | 1 | A | 5-mm-thick coils were manufactured by continuous cast-rolling | Annealed at 300° C. for 2 hours → cold-rolled to 0.7 mm → annealed at 350° C. for 2 hours → cold-rolled to 0.072 mm → final annealing for 400° C. for 2 hours (recrystallization not completed) → cold-rolled to 0.06 mm (thickness of the fin material) |
| | 2 | A | Same as No. 1 | Cold-rolled to 0.8 mm → annealed at 300° C. for 2 hours → cold-rolled to 0.075 mm → final annealing at 430° C. for 2 hours (recrystallization not completed) → cold-rolled to 0.06 mm (thickness of the fin material) |
| | 3 | A | Same as No. 1 | Cold-rolled to 1.0 mm → annealed at 300° C. for 2 hours → cold-rolled to 0.072 mm → final annealing at 380° C. for 2 hours (recrystallization not completed) → cold-rolled to 0.06 mm (thickness of the fin material) |
| | 4 | B | 6-mm-thick coils were manufactured by continuous cast-rolling | Cold-rolled to 0.7 mm → annealed at 340° C. for 2 hours → cold-rolled to 0.075 mm → final annealing at 400° C. for 2 hours (recrystallization not completed) → cold-rolled to 0.06 mm (thickness of the fin material) |
| | 5 | C | 7-mm-thick coils were manufactured by continuous cast-rolling | Annealed at 350° C. for 2 hours → cold-rolled to 0.9 mm → annealed at 350° C. for 2 hours → cold-rolled to 0.075 mm → final annealing at 420° C. for 2 hours (recrystallization not completed) → cold-rolled to 0.06 mm (thickness of the fin material) |
| | 6 | D | 4-mm-thick coils were manufactured by continuous cast-rolling | Cold-rolled to 0.7 mm → annealed at 340° C. for 2 hours → cold-rolled to 0.075 mm → final annealing at 400° C. for 2 hours (recrystallization not completed) → cold- |

TABLE 2-continued

| | No. | Alloy No. | Method for manufacturing coils before cold-rolling | Cold-rolling and annealing conditions (the underlined indicates the sheet thickness and conditions of annealing carried out the second last annealing |
|---|---|---|---|---|
| | | | | rolled to 0.06 mm (thickness of the fin material) |
| Comparative examples | 7 | A | After manufacturing 400-mm-thick ingots by the DC casting method, 5-mm-thick coil was manufactured by surface planing and hot rolling. | Cold-rolled to 0.8 mm → annealed at 300° C. for 2 hours → cold-rolled to 0.075 mm → final annealing at 430° C. for 2 hours (recrystallization completed) → cold-rolled to 0.06 mm (thickness of the fin material). Note: Same as No. 2 but recrystallization is completed at the final annealing, due to the DC manufacturing method |
| | 8 | A | Same as No. 1 | Cold-rolled to 2.8 mm → annealed at 300° C. for 2 hours → cold-rolled to 0.072 mm → final annealing at 430° C. for 2 hours (recrystallization not completed) → cold-rolled to 0.06 mm (thickness of the fin material) |
| | 9 | B | Same as No. 4 | Cold-rolled to 0.7 mm → annealed at 450° C. for 2 hours → cold-rolled to 0.075 mm → final annealing at 480° C. for 2 hours (recrystallization completed) → cold-rolled to 0.06 mm (thickness of the fin material) |
| | 10 | C | Same as No. 5 | Cold-rolled to 3.2 mm → annealed at 520° C. for 2 hours → cold-rolled to 0.075 mm → final annealing at 450° C. for 2 hours (recrystallization completed) → cold-rolled to 0.06 mm (thickness of the fin material) |
| | 11 | D | Same as No. 6 | Cold-rolled to 0.075 mm → final annealing at 380° C. for 2 hours (recrystallization not completed) → cold-rolled to 0.06 mm (thickness of the fin material) |
| | 12 | E | 4-mm-thick coils were manufactured by continuous cast-rolling | Cold-rolled to 0.7 mm → annealed at 340° C. for 2 hours → cold-rolled to 0.075 mm → final annealing at 400° C. for 2 hours (recrystallization not completed) → cold-rolled to 0.06 mm (thickness of the fin material) |

TABLE 3

| No. | Cold-rolling condition | Corrosion test results (Corrosion Mass loss ratio: %) |
|---|---|---|
| | This invention examples | |
| 1 | Free of breakage during cold-rolling | 9% |
| 2 | Free of breakage during cold-rolling | 8% |
| 3 | Free of breakage during cold-rolling | 9% |
| 4 | Free of breakage during cold-rolling | 14% |
| 5 | Free of breakage during cold-rolling | 12% |
| 6 | Free of breakage during cold-rolling | 10% |
| | Comparative examples | |
| 7 | Free of breakage during cold-rolling | 28% |
| 8 | Broke at 0.08 mm | 10% |
| 9 | Free of breakage during cold-rolling | 32% |
| 10 | Broke at 0.08 mm | 29% |
| 11 | Broke at 0.1 mm | 11% |
| 12 | Broke at 0.1 mm | 27% |

As is apparent from the results in Table 3, the fin materials, manufactured according to the present invention, were free of breakage and were able to be rolled to 0.06 mm of thickness, but the comparative examples, manufactured under conditions different from those in the present inventions, were unable to be rolled halfway, and breakage occurred. The examples according to the present invention caused less mass loss due to corrosion than the comparative examples, and the resultant fin materials were excellent in corrosion resistance by themselves.

Having described our invention as related to the present embodiments, it is our intention that the invention not be limited by any of the details of the description, unless otherwise specified, but rather be construed broadly within its spirit and scope as set out in the accompanying claims.

What we claim is:

1. A method of producing an aluminum alloy fin material for brazing, which comprises:

casting an aluminum alloy by continuous cast-rolling to produce a cast coil with a thickness of 2.5 mm or more but 9 mm or less, wherein the aluminum alloy comprises more than 0.1 wt % but 3 wt % or less of Ni, more than 1.5 wt % but 2.2 wt % or less of Fe, and 1.2 wt % or less of Si, and at least one selected from the group consisting of 4 wt % or less of Zn, 0.3 wt % or less of In, and 0.3 wt % or less of Sn, and further comprises, if necessary, at least one selected from the group consisting of 3.0 wt % or less of Co, 0.3 wt % or less of Cr, 0.3 wt % or less of Zr, 0.3 wt % or less of Ti, 1 wt % or less of Cu, 0.3 wt % or less of Mn, and 1 wt % or less of Mg, the balance being unavoidable impurities and aluminum, cold-rolling the aluminum alloy;

annealing the aluminum alloy at 250 to 500° C.

repeating the cold rolling one or more additional times and optionally repeating the annealing between repeated cold rolling until a cold rolled aluminum alloy of 0.4 mm or more but 2.0 mm or less thickness is produced;

annealing at 250 to 500° C. the 0.4 to 2 mm thick cold rolled aluminum alloy;

cold rolling the aluminum alloy thereby producing the aluminum alloy fin material of a thickness of 0.10 mm or less; and performing a final annealing under heating conditions that do not allow complete recrystallization.

2. The method as claimed in claim 1, wherein an aluminum alloy contains 0.9 to 2.0 wt % of Ni.

3. The method as claimed in claim 1, wherein an aluminum alloy contains more than 1.5 wt % but 2.0 wt % or less of Fe.

4. The method as claimed in claim 1, wherein an aluminum alloy contains 0.3 to 1.0 wt % of Zn.

5. The method as claimed in claim 1, wherein an aluminum alloy contains 0.3 to 2.0 wt % of Co.

6. The method as claimed in claim 1, wherein an aluminum alloy contains 0.05 to 0.3 wt % of Cu.

7. The method as claimed in claim 1, wherein annealing the aluminum alloy having the thickness of 0.4 mm or more but 2 mm or less is carried out for the cold-rolled aluminum alloy sheet of 0.6 to 1.2 mm thickness, during the cold-rolling process.

8. The method as claimed in claim 1, wherein the final annealing temperature is in the range of 350 to 460° C.

9. The method as claimed in claim 1, wherein the final annealing is carried out during the cold-rolling process before achieving final 10% or more of cold-rolling ratio.

* * * * *